United States Patent [19]

Owen

[11] Patent Number: 4,820,404

[45] Date of Patent: Apr. 11, 1989

[54] COOLING OF STRIPPED CATALYST PRIOR TO REGENERATION IN CRACKING PROCESS

[75] Inventor: Hartley Owen, Belle Mead, N.J.

[73] Assignee: Mobil Oil Corporation, New York, N.Y.

[21] Appl. No.: 14,964

[22] Filed: Feb. 17, 1987

Related U.S. Application Data

[63] Continuation of Ser. No. 814,714, Dec. 30, 1985, abandoned.

[51] Int. Cl.[4] ..... C10G 11/18

[52] U.S. Cl. ..... 208/159; 208/164; 422/144; 502/044

[58] Field of Search ..... 208/113, 150, 151, 159, 208/164; 422/144, 146, 203, 223; 502/44

[56] References Cited

U.S. PATENT DOCUMENTS

| | | | |
|---|---|---|---|
| 3,821,103 | 6/1974 | Owen | 208/72 |
| 4,664,778 | 5/1987 | Reinkemeyer | 208/113 |
| 4,724,065 | 2/1988 | Bartholic et al. | 208/86 |

*Primary Examiner*—Olik Chaudhuri

*Attorney, Agent, or Firm*—Alexander J. McKillop; Charles J. Speciale; Richard D. Stone

[57] ABSTRACT

A fluid catalytic cracking process and apparatus is described which includes a high temperature stripper (hot stripper) to control the carbon level and sulfur on spent catalyst, followed by catalyst cooling to control the regeneration inlet temperature. The high temperature stripper operates at a temperature between 100° F. above the temperature of a catalyst-hydrocarbon mixture exiting a riser and 1500° F. The regenerator inlet temperature is controlled to obtain the desired regeneration temperature, regenerator outlet temperature, and degree of regeneration. The regenerator is maintained at a temperature between 100° F. above that of the catalyst in the high temperature stripper and 1600° F. The present invention has the advantage that it separates hydrogen from catalyst to eliminate hydrothermal degradation, and separates sulfur from catalyst as hydrogen sulfide and mercaptans which are easy to scrub. The catalyst cooler enables the regenerator and high temperature stripper to be run independently at respective desired temperatures.

9 Claims, 1 Drawing Sheet

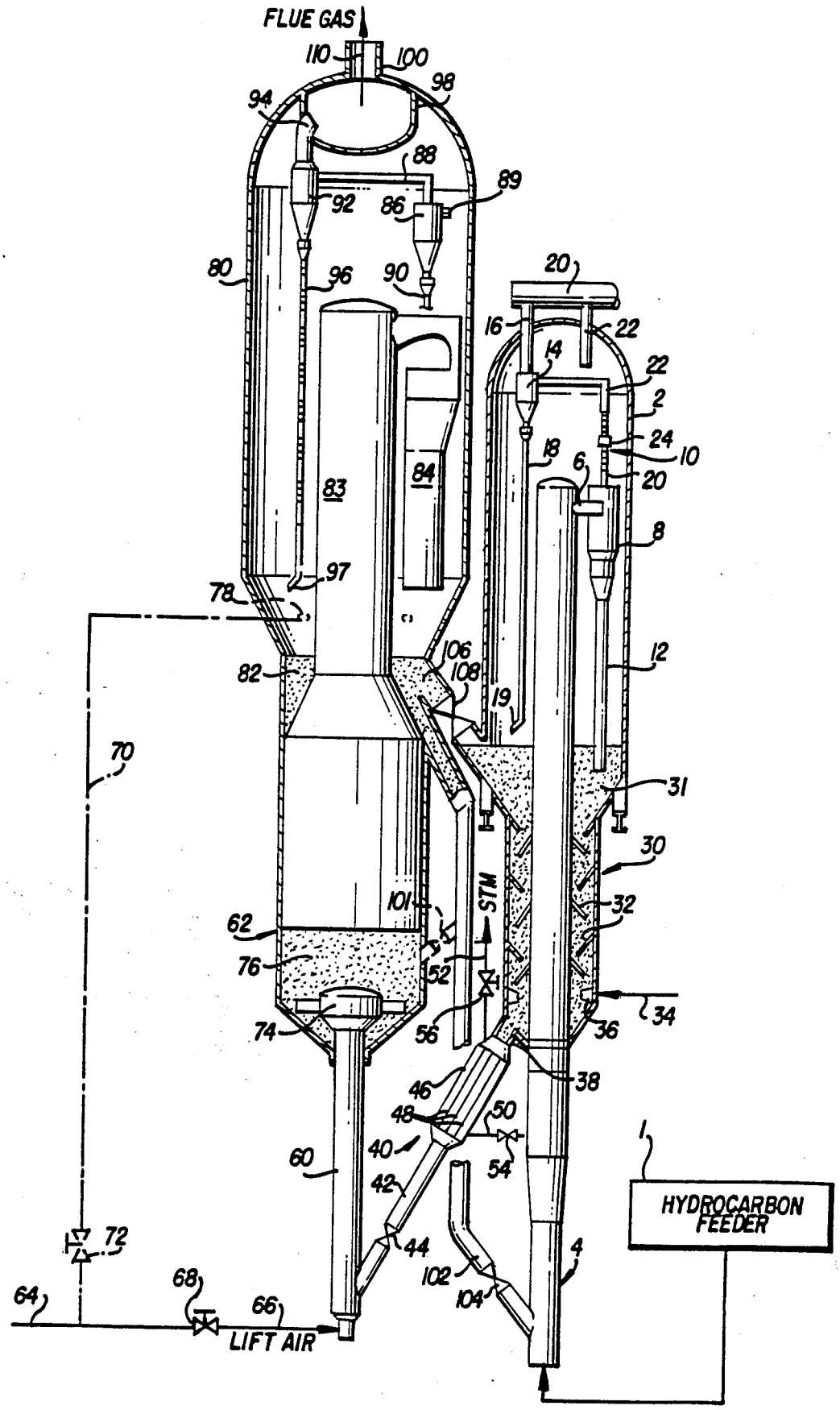
FLUE GAS
110
100
98
94
88
89
92
86
80
96
90
20
16
22
14
22
2
24
10
18
6
20
83
84
8
97
78
12
106
108
82
19
70
31
30
STM
101
32
62
76
52
56
34
74
36
38
46
48
50
40
54
60
42
1
HYDROCARBON FEEDER
72
44
4
102
104
68
64
66
LIFT AIR

COOLING OF STRIPPED CATALYST PRIOR TO REGENERATION IN CRACKING PROCESS

This is a continuation of copending application Ser. No. 814,714, filed on Dec. 30, 1985 now abandoned.

BACKGROUND OF THE INVENTION

1. Field of the Invention

This invention is concerned with a fluidized catalytic cracking process wherein coked deactivated catalyst is subject to high temperature stripping to control the carbon level on spent catalyst. More particularly, the concept employs a high temperature stripper to control the carbon level on the spent catalyst, followed by catalyst cooling to control the temperature of the catalyst to regeneration.

2. Description of the Prior Art

The field of catalytic cracking has undergone progressive development since 1940. The trend of development of the fluid catalytic cracking process has been to all riser cracking, use of zeolite-containing catalysts and heat balanced operation.

Other major trends in fluid catalytic cracking processing have been modifications to the process to permit it to accommodate a wider range of feedstocks, in particular, feedstocks that contain more metals and sulfur than had previously been permitted in the feed to a fluid catalytic cracking unit.

Along with the development of process modifications and catalysts, which could accommodate these heavier, dirtier feeds, there has been a growing concern about the amount of sulfur contained in the feed that ends up as $SO_x$ in the regenerator flue gas. Higher sulfur levels in the feed, combined with a more complete regeneration of the catalyst in the fluid catalytic cracking regenerator tends to increase the amount of $SO_x$ contained in the regenerator flue gas. Some attempts have been made to minimize the amount of $SO_x$ discharged to the atmosphere through the flue gas by providing agents to react with the $SO_x$ in the fluid gas. The agents pass along with the regenerated catalyst back to the fluid catalytic cracking reactor, and then the reducing atmosphere releases the sulfur compounds as $H_2S$. Suitable agents for this purpose have been described in U.S. Pat. Nos. 4,071,436 and 3,834,031. Use of a cerium oxide agent for this purpose is shown in U.S. Pat. No. 4,001,375.

Unfortunately, the conditions in most fluid catalytic cracking regenerators are not the best of $SO_x$ adsorption. The high temperatures encountered in modern fluid catalytic cracking regenerators (up to 1600° F.) tend to discourage $SO_x$adsorption. One approach to overcome the problem of $SO_x$ in flue gas is to pass catalyst from a fluid catalytic cracking reactor to a long residence time steam stripper. After the long residence time steam striping, the catalyst passes to the regenerator, as disclosed by U.S. Pat. No. 4,481,103 to Krambeck et al, which is incorporated herein by reference. However, this process preferably steam strips spent catalyst at 932° to 1022° F. (500°-550° C.), which is not sufficient to remove some undesirable sulfur- or hydrogen-containing components. Furthermore, catalyst passing from a fluid catalytic cracking stripper to a fluid catalytic cracking regenerator contains hydrogen-containing components, such as coke, adhering thereto. This causes hydrothermal degradation when the hydrogen reacts with oxygen in the regenerator to form water.

U.S. Pat. No. 4,336,160 to Dean et al attempts to reduce hydrothermal degradation by staged regeneration. However, the flue gas from both stages of regeneration contains $SO_x$ which is difficult to clean.

Another need of the prior art is to provide improved means for controlling fluid catalytic cracking regeneration temperature. Improved regenerator temperature control is desirable, because regenerator temperatures above 1600° F. (871° C.) can deactivate fluid cracking catalyst. Typically, the temperature is controlled by adjusting the $CO/CO_2$ ratio produced in the regenerator. This control works on the principle that production of CO produces less heat than production of $CO_2$. However, in some cases, this control is insufficient.

It would be desirable to separate hydrogen from catalyst to eliminate hydrothermal degradation. It would be further advantageous to remove sulfur-containing compounds prior to regeneration to prevent $SO_x$ from passing into the regenerator flue gas. Also, it would be advantageous to better control regenerator temperature.

U.S. Pat. No. 4,353,812 to Lomas et al discloses cooling catalyst from a regenerator by passing it through the shell side of a heat-exchanger with a cooling medium through the tube side. The cooled catalyst is recycled to the regeneration zone. This process is disadvantageous, in that is does not control the temperature of catalyst from the reactor to the regenerator.

The prior art also includes fluid catalytic cracking processes which utilize dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper; 2,873,175 to Owens; 2,862,798 to McKinney; 2,596,748 to Watson et al; 2,515,156 to Jahnig et al; 2,492,948 to Berger; and 2,506,123 to Watson. The processes disclosed in these patents have the disadvantage that the regenerator operating temperature is affected with the temperature of catalyst from the stripper to the regenerator.

SUMMARY OF THE INVENTION

Accordingly, the present invention comprises a fluid catalytic cracking process and apparatus which employs a high temperature stripper, followed by cooling of the stripped catalyst to control a regenerator inlet temperature.

A further object of the invention is to provide a fluid catalytic cracking process and apparatus for maintaining a stripper at a temperature greater than that of a riser exit temperature by mixing hot regenerated catalyst into the stripper.

Another object of the present invention is to provide a fluid catalytic cracking process and apparatus for maintaining a desired regenerator temperature independently of a temperature at which catalyst is stripped.

Another object of the present invention is to provide a high temperature stripper to eliminate hydrothermal degradation in a fluid catalytic cracking regenerator.

Another object of the present invention is to provide a high temperature stripper to remove sulfur from coked catalyst as hydrogen sulfide and mercaptans prior to fluid catalytic cracking regeneration.

The present invention provides a process for controlling the fluid catalytic cracking of a feedstock containing hydrocarbons, comprising the steps of:

passing a mixture comprising catalyst and the feedstock through a rise conversion zone under fluid catalytic cracking conditions to crack the feedstock;

passing the mixture, having a riser exit temperature, from the riser into a fluid catalytic cracking reactor vessel;

separating a portion of catalyst from the mixture, with the remainder of the mixture forming a reactor vessel gaseous stream;

heating the separated catalyst portion by combining the separated catalyst portion with a portion of regenerated catalyst from a fluid catalytic cracking regenerator vessel to form combined catalyst;

stripping the combined catalyst, by contact with a stripping gas stream, at a stripping temperature between 100° F. (56° C.) above the riser exit temperature and 1500° F. (816° C.), the regenerated catalyst portion having a temperature between 100° F. (56° C.) above the stripping temperature and 1600° F. (871° C.) prior to heating the separated catalyst;

cooling the stripped catalyst, prior to passing it into the regenerator vessel, to a temperature sufficient to cause the regenerator vessel to be maintained at a temperature between 100° F. (56° C.) above the stripping temperature and 1600° F. (871° C.); and regenerating the cooled catalyst stream in the fluid catalytic cracking regenerator vessel by contact with an oxygen-containing stream at fluid catalytic cracking regeneration conditions.

The riser exit temperature is defined as the temperature of the catalyst-hydrocarbon mixture exiting from the riser. The riser exit temperature may be at any suitable temperature. However, a riser exit temperature of 900° to 1100° F. (482°-593° C.) is preferred, and 1000° to 1050° F. (538°-566° C.) is most preferred.

More particularly the present invention provides a process for controlilng the fluid catalytic cracking of a feedstock containing hydrocarbons and sulfur-containing compounds, comprising the steps of:

passing a mixture comprising catalyst and the feedstock through a riser conversion zone at fluid catalytic cracking conditions to crack the feedstock;

passing the mixture, having a riser exit temperature between 1000° and 1050° F. (538°-566° C.), from the riser conversion zone to a closed cyclone system located within a fluid catalytic cracking reactor vessel;

separating a portion of catalyst from the mixture in the closed cyclone system, with the remainder of the mixture forming a reactor vessel gaseous stream;

heating the separated catalyst portion by combining the separated catalyst portion in the reactor vessel, with a portion of regenerated catalyst from a fluid catalytic cracking regenerator vessel to form combined catalyst;

stripping the combined catalyst, by contact with a stripping gas stream in the reactor vessel, under stripping conditions comprising a stripping temperature between 150° F. (83° C.) above the riser exit temperature and 1400° F. (760° C.) and a residence time of a gaseous stream from 0.5 to 5 seconds, the regenerated catalyst portion having a temperature between 150° F. (83° C.) above the stripping temperature and 1600° F. (871° C.) prior to heating the separated catalyst, wherein the separated catalyst portion comprises sulfur-containing compounds and hydrocarbons derived from the feedstock, the stripping conditions are sufficient to separate 45 to 55% of the sulfur-containing compounds and 70 to 80% of hydrogen from the hydrocarbons in the separated catalyst portion of the combined catalyst to produce the gaseous stream, and the gaseous stream comprises stripping gas and molecular hydrogen, hydrocarbons and the sulfur-containing hydrocarbons separated from the separated catalyst;

cooling the stripped catalyst stream to between 50° and 150° F. (28°-83° C.) below the stripping temperature by indirect heat-exchange with a heat-exchange medium in a heat-exchanger located outside the reactor vessel, causing the regenerator vessel to be maintained at a temperature between 150° F. (83° C.) above the stripping temperature and 1600° F. (871° C.), thereby maintaining said regenerator vessel temperature independently of the stripping step temperature; and regenerating the cooled catalyst stream in the fluid catalytic cracking regenerator vessel, by contact with an oxygen-containing stream under fluid catalytic cracking regeneration conditions.

In its apparatus respects, the present invention provides an apparatus for controlling the fluid catalytic cracking of a feedstock comprising hydrocarbons, comprising:

means defining a riser conversion zone through which a mixture comprising catalyst and the feedstock passes at fluid catalytic cracking conditions to crack the feedstock;

a fluid catalytic cracking reactor vessel;

means for passing the mixture from the riser into the fluid catalytic cracking reactor vessel, said mixture having a riser exit temperature as it passes into said reactor vessel;

means for separating a portion of catalyst from the mixture, with the remainder of the mixture forming a reactor vessel gaseous stream;

means for heating the separated catalyst portion, comprising means for combining the separated catalyst portion with a portion of regenerated catalyst to form combined catalyst;

means for stripping the combined catalyst by contact with a stripping gas stream to form a stripped catalyst stream;

a fluid catalytic cracking regenerator vessel for producing the portion of regenerated catalyst; and a heat-exchanger for cooling the stripped catalyst stream, the heat-exchanger being located outside the reactor vessel, the fluid catalytic cracking regenerator vessel thereby regenerating the cooled catalyst stream by contact with an oxygen-containing stream at fluid catalytic cracking regenerator conditions.

In its more particular apparatus aspects, the present invention provides an apparatus for controlling the fluid catalytic cracking of a feedstock comprising hydrocarbons and sulfur-containing compounds, comprising:

means defining a riser conversion zone through which a mixture comprising catalyst and the feedstock passes at fluid catalytic cracking conditions to crack the feedstock;

a fluid catalytic cracking reactor vessel;

means for passing the mixture from the riser conversion zone to a closed cyclone system located within the fluid catalytic cracking reactor vessel, the mixture having a riser exit temperature between 1000° and 1050° F. (538°-566° C.) as it passes from the riser to the closed cyclone system, the closed cyclone system including means for separating a portion of catalyst from the mixture and forming a reactor vessel gaseous stream from the remainder of the mixture;

means for heating the separated portion of catalyst, comprising means for combining a portion of regenerated catalyst with the separated catalyst portion to form a combined catalyst in the reactor vessel;

means for stripping the combined catalyst by contact with a stripping gas in the reactor vessel, thereby maintaining the combined catalyst in the means for stripping at a stripping temperature between 150° F. (83° C.) above the temperature of the mixture exiting the riser and 1400° F. (760° C.) and a residence time of gas in the means for stripping from 0.5 to 5 seconds, the separated catalyst portion comprising hydrocarbons and sulfur-containing compounds derived from the feedstock, the means for stripping thereby separating 45 to 55% of the sulfur-containing compounds and 70 to 80% of hydrogen from the hydrocarbons in the separated catalyst portion;

a stripped catalyst effluent conduit, attached to the reactor vessel for passing the stripped catalyst stream therethrough;

a fluid catalytic cracking regenerator vessel for producing the portion of regenerated catalyst at a temperature between 150° F. (83° C.) above the stripping temperature and 1600° F. (871° C.); and an indirect heat-exchanger attached to the reactor effluent conduit, whereby the indirect heat-exchanger is sufficiently sized for cooling the stripped catalyst stream to a temperature between 50° and 150° F. (28°–83° C.) below the stripping temperature, thereby causing the catalyst in the regenerator vessel to be maintained at a temperature between 150° F. (83° C.) above the stripping temperature and 1600° F. (871° C.), causing the temperature of the catalyst in the regenerator vessel to be maintained independently of the stripping temperature, the regenerator vessel regenerating the cooled catalyst stream by contacting it with an oxygen-containing stream under fluid catalytic cracking regeneration conditions.

The present invention strips catalyst at a temperature higher than the riser exit temperature to separate hydrogen, as molecular hydrogen or hydrocarbons from the coke which adheres to catalyst, to eliminate hydrothermal degradation, which typically occurs when hydrogen reacts with oxygen in a fluid catalytic cracking regenerator to form water. The high temperature stripper (hot stripper) also removes sulfur from coked catalyst as hydrogen sulfide and mercaptans, which are easy to scrub. In contrast, removing sulfur from coked catalyst in a regenerator produces $SO_x$, which passes into the regenerator flue gas and is more difficult to scrub. Furthermore, the high temperature stripper removes additional valuable hydrocarbon products to prevent burning these hydrocarbons in the regenerator. An additional advantage of the high temperature stripper is that it quickly separates hydrocarbons from catalyst. If catalyst contacts hydrocarbons for too long a time at a temperature greater than or equal to 1000° F. (538° C.), then diolefins are produced which are undesirable for downstream processing, such as alkylation. However, the present invention allows a precisely controlled, short contact time at 1000° F. (538° C.) or greater to produce premium, unleaded gasoline with high selectivity.

The heat-exchanger (catalyst cooler) controls regenerator temperature. This allows the hot stripper to run at a desired temperature to control sulfur and hydrogen without interfering with a desired regenerator temperature. It is desired to run the regenerator at least 100° F. (56° C.) hotter than the hot stripper. However, the regenerator temperature should be kept below 1600° F. (871° C.) to prevent deactivation of the catalyst.

BRIEF DESCRIPTION OF THE DRAWING

The drawing is a schematic representation of a high temperature stripper and catalyst cooler of the present invention.

DETAILED DESCRIPTION OF THE PRESENT INVENTION

The FIGURE illustrates a fluid catalytic cracking system of the present invention. In the FIGURE, a hydrocarbon feed passes from a hydrocarbon feeder 1 to the lower end of a riser conversion zone 4. Regenerated catalyst from a standpipe 102, having a control valve 104, is combined with the hydrocarbon feed in the riser 4, such that a hydrocarbon-catalyst mixture rises in an ascending dispersed stream and passes through a riser effluent conduit 6 into a first reactor cyclone 8. The riser exit temperature, defined as the temperature at which the mixture passes from the riser 4 to conduit 6, ranges between 900° and 1100° F., and preferably between 1000° and 1050° F. The riser exit temperature is controlled by monitoring and adjusting the rates and temperatures of hydrocarbons and regenerated catalyst into the riser 4. Riser effluent conduit 6 is attached at one end to the riser 4 and at its other end to the cyclone 8.

The first reactor cyclone 8 separates a portion of catalyst from the catalyst-hydrocarbon mixture and passes this catalyst down a first reactor cyclone dipleg 12 to a stripping zone 30 located therebelow. The remaining gas and catalyst pass from the first reactor cyclone 8 through a gas effluent conduit 10. The conduit 10 is provided with a connector 24 to allow for thermal expansion. The catalyst passes through the conduit 10, then through a second reactor cyclone inlet conduit 22, and into a second reactor cyclone 14. The second cyclone 14 separates the stream to form a catalyst stream, which passes through a second reactor cyclone dipleg 18 to the stripping zone 30 located therebelow, and an overhead stream.

The second cyclone overhead stream, which contains the remaining gas and catalyst, passes through a second cyclone gaseous effluent conduit 16 to a reactor overhead port 20. Gases from the atmosphere of the reactor vessel 2 may pass through a reactor overhead conduit 22 into the reactor overhead port 20. The gases which exit the reactor 2 through the second cyclone gaseous effluent conduit 16 and the reactor overhead conduit 22 are combined and exit through the reactor overhead port 20. It will be apparent to those skilled in the art that although only one series connection of cyclones 8, 14 is shown in the embodiment, more than one series connection and/or more or less than two consecutive cyclones in series connection could be employed.

The mixture of catalyst and hydrocarbons passes through the first reactor cyclone overhead conduit 10 and the second reactor cyclone inlet conduit 22 without entering the reactor vessel 2 atmosphere. However, the connector 24 may provide an annular port to admit stripping as from the reactor vessel 2 into the conduit 10 to aid in separating catalyst from hydrocarbons adhering thereto. The closed cyclone system and annular port is described more fully in U.S. Pat. No. 4,502,947 to Hadded et al, which is incorporated herein by reference.

The separated catalyst from cyclones 8, 14 pass through respective diplegs 12, 18 and are discharged therefrom after a suitable pressure is generated within the diplegs by the buildup of the catalyst. The catalyst falls from the diplegs into a bed of catalyst 31 located in the stripping zone 30. The first dipleg 12 is sealed by being extended into the catalyst bed 31. The second dipleg 18 is sealed by a trickle valve 19. The separated catalyst is contacted and combined with hot regenerated catalyst from regenerator 80 in the stripping zone 30. The regenerated catalyst has a temperature in the range between 100° F. above that of the stripping zone 30 and 1600° F. to heat the separated catalyst in bed 31. The regenerated catalyst passes from the regenerator 80 to the reactor vessel 2 through a transfer line 106 attached at one end to the regenerator vessel 80 and at another end to the reactor vessel 2. The transfer line 106 is provided with a slide valve 108. Combining the separated catalyst with the regenerated catalyst promotes the stripping at a temperature in the range between 100° F. above the riser exit temperature and 1500° F. Preferably, the catalyst stripping zone operates at a temperature between 150° F. above the riser exit temperature and 1400° F.

The catalyst 31 in the stripping zone 30 is contacted at high temperature, discussed above, with a stripping gas, such as steam, flowing countercurrently to the direction of flow of the catalyst. The stripping gas is introduced into the lower portion of the stripping zone 30 by one or more conduits 34 attached to a stripping gas header 36. The catalyst residence time in the stripping zone 30 ranges from 2.5 to 7 minutes. The vapor residence time in the catalyst stripping zone 30 ranges from 0.5 to 30 seconds, and preferably 0.5 to 5 seconds. The stripping zone 30 removes coke, sulfur and hydrogen from the separated catalyst which has been combined with the regenerated catalyst. The sulfur is removed as hydrogen sulfide and mercaptans. The hydrogen is removed as molecular hydrogen, hydrocarbons, and hydrogen sulfide. Most preferably, the stripping zone 30 is maintained at temperatures between 150° F. above the riser exit temperature, which are sufficient to reduce coke load to the regenerator by at least 50%, remove 70–80% of the hydrogen as molecular hydrogen, light hydrocarbons and other hydrogen-containing compounds, and remove 45 to 55% of the sulfur as hydrogen sulfide and mercaptans, as well as a portion of nitrogen as ammonia and cyanides.

The catalyst stripping zone 30 may also be provided with trays (baffles) 32. The trays may be disc- and doughnut-shaped and may be perforated or unperforated.

Stripped catalyst passes through a stripped catalyst effluent conduit 38 to a catalyst cooler 40. The catalyst cooler 40 is a heat-exchanger which cools the stripped catalyst from the reactor vessel 2 to a temperature sufficient to maintain the regenerator vessel 80 at a temperature between 100° F. above the temperature of the stripping zone 30 and 1600° F. Preferably, the catalyst cooler 40 cools the stripped catalyst stream to a temperature sufficient to control the regenerator vessel 80 at a temperature to between 150° F. above the temperature of the stripping zone 30 and 1600° F. Most preferably, the stripped catalyst stream is cooled between 50° and 150° F. below the stripping zone temperature, so long as the cooled catalyst temperature is at least 1100° F.

The catalyst cooler 40 is preferably an indirect heat-exchanger located outside the reactor vessel 2. A heat-exchange medium, such as liquid water (boiler feed water), passes through a conduit 50, provided with a valve 54, into a set of tubes 48 within the catalyst cooler 40. The catalyst passes through the shell side 46 of the catalyst cooler 40. The catalyst cooler 40 is attached to an effluent conduit 42 provided with a slide valve 44. The cooled catalyst passes through the conduit 42 into a regenerator inlet conduit 60.

In the regenerator riser 60, air and cooled catalyst combine and pass upwardly through an air catalyst disperser 74 into a fast fluid bed 62. The fast fluid bed 62 is part of the regenerator vessel 80. In the fast fluid bed 62, combustible materials, such as coke which adheres to the cooled catalyst, are burned off the catalyst by contact with lift air. Air passes through an air supply line 66 through a control valve 68 and an air transfer line 68 to the regenerator inlet conduit 60. Optionally, if the temperature of the cooled catalyst from the conduit 42 is less than 1100° F., a portion of hot regenerated catalyst from the standpipe 102 passes through a conduit 101, provided with a control valve 103, into the fast fluid bed 62. The fast fluid bed 62 contains a relatively dense catalyst bed 76. The air fluidizes the catalyst in bed 76, and subsequently transports the catalyst continuously as a dilute phase through the regenerator riser 83. The dilute phase passes upwardly through the riser 83, through a radial arm 84 attached to the riser 83, and then passes downwardly to a second relatively dense bed of catalyst 82 located within the regenerator vessel 80.

The major portion of catalyst passes downwardly through the radial arms 84, while the gases and remaining catalyst pass into the atmosphere of the regenerator vessel 80. The gases and remaining catalyst then pass through an inlet conduit 89 and into the first regenerator cyclone 86. The first cyclone 86 separates a portion of catalyst and passes it through a first dipleg 90, while remaining catalyst and gases pass through an overhead conduit 88 into a second regenerator cyclone 92. The second cyclone 92 separates a portion of catalyst and passes the separated portion through a second dipleg 96 having a trickle valve 97, with the remaining gas and catalyst passing through a second overhead conduit 94 into a regenerator vessel plenum chamber 98. A flue gas stream 110 exits from the regenerator plenum chamber 98 through a regenerator flue gas conduit 100.

The regenerated catalyst settles to form the bed 82, which is dense compared to the dilute catalyst passing through the riser 83. The regenerated catalyst bed 82 is at a substantially higher temperature than the stripped catalyst from the stripping zone 30, due to the coke burning which occurs in the regenerator 80. The catalyst in bed 82 is at least 100° F. hotter than the temperature of the stripping zone 30, preferably at least 150° F. hotter than the temperature of the stripping zone 30. The regenerator temperature is, at most, 1600° F. to prevent deactivating the catalyst. Coke burning occurs in the regenerator inlet conduit 60, as well as the fast fluid bed 62 and riser 83.

Optionally, air may also be passed from the air supply line 64 to an air transfer line 70, provided with a control valve 72, to an air header 78 located in the regenerator 80. The regenerated catalyst then passes from the relatively dense bed 82 through the conduit 106 to the stripping zone 30 to provide heated catalyst for the stripping zone 30.

Any conventional fluid catalytic cracking catalyst can be used in the present invention. Use of zeolite catalysts in an amorphous base is preferred. Many suitable catalysts are discussed in U.S. Pat. No. 3,926,778 to Owen et al.

One example of a process which can be conducted in accordance with the present invention begins with a 650° to 1100° F. boiling point hydrocarbon feedstock which passes into a riser conversion zone 4, where it combines with hot regenerated catalyst at a temperature of about 1500° F. from a catalyst standpipe 102 to form a catalyst-hydrocarbon mixture. The catalyst-hydrocarbon mixture passes upwardly through the riser conversion zone 4 and into a riser effluent conduit 6 at a riser exit temperature of about 1000° F. The catalyst passes from the conduit 6 into the first reactor cyclone 8, where a portion of catalyst is separated from the mixture and drops through a dipleg 12 to a bed of catalyst 31 contained within a stripping zone 30 therebelow. The stripping zone 30 operates at about 1300° F. The remainder of the mixture passes upwardly through the first overhead conduit 10 into a second reactor cyclone 14. The second cyclone 14 separates a portion of catalyst from the first cyclone overhead stream and passes the separated catalyst down the second dipleg 18. The remaining solids and gases pass upwardly as a second cyclone overhead stream through conduit 16 into the reactor vessel overhead port 20.

In the stripping zone 30, the catalyst from diplegs 12, 18 combines with catalyst from regenerator 80, which passes through a conduit 106 and is stripped by contact with steam from a steam header 36. The regenerated catalyst from the conduit 106 is at a temperature of about 1500° F. and provides heat to maintain the stripping zone 30 at about 1300° F. The stripped catalyst passes through a conduit 38 into a catalyst cooler 40 at a temperature of about 1300° F. The catalyst cooler 40 cools the 1300° F. catalyst to about 1150° F. The cooling occurs by indirect heat-exchange of the hot stripped catalyst with boiler feed water, which passes through a conduit 50 to form steam which exits through a conduit 52.

The cooled catalyst, at a temperature of about 1150° F., combines with lift air from a conduit 66 in a regenerator inlet conduit 60 to form an air-catalyst mixture. The mixture passes upwardly through the conduit 60 into fast fluid bed 76. The catalyst continues upwardly from fast fluid bed 76 through the regenerator riser 83 and into a regenerator vessel 80. The catalyst is then separated from gases by the radial arm 84, as well as cyclones 86 and 92, and passes downwardly through the regenerator to form a relatively dense bed 82. The coke adhering to the stripped catalyst burns in the conduit 60, the fast fluid bed 62, the riser 83, and the regenerator vessel 80. Due to the coke burning, the catalyst in bed 82 is heated to a temperature of about 1500° F. Catalyst bed 82 then supplies catalyst for the standpipe 102, which combines with the hydrocarbon feedstock. Bed 82 also provides catalyst for conduit 106 which passes to the stripping zone 30. Gaseous effluents pass through a first cyclone 86 and second cyclone 92 and leave the regenerator 80 as a flue gas stream 110 through a flue gas conduit 100.

Operating the stripping zone as a high temperature (hot) stripper, at a temperature between 100° F. above a riser exit temperature and 1500° F., has the advantage that it separates hydrogen, as molecular hydrogen as well as hydrocarbons, from catalyst. Hydrogen removal eliminates hydrothermal degradation, which typically occurs when hydrogen reacts with oxygen in a fluid catalytic cracking regenerator to form water. The hot stripper also removes sulfur from coked catalyst as hydrogen sulfide and mercaptans, which are easy to scrub. By removing sulfur from coked catalyst in the hot stripper, the hot stripper prevents formation of $SO_x$ in the regenerator. It is more difficult to remove $SO_x$ from regenerator flue gas than to remove hydrogen sulfide and mercaptans from a hot stripper effluent. The hot stripper enhances removal of hydrocarbons from spent catalyst, and thus prevents burning of valuable hydrocarbons in the regenerator. Furthermore, the hot stripper quickly separates hydrocarbons from catalyst to avoid overcracking.

Preferably the hot stripper is maintained at a temperature between 150° F. above a riser exit temperature and 1400° F. to reduce coke load to the regenerator by at least 50%, and strip away 70 to 80% of the hydrogen as molecular hydrogen, light hydrocarbons and other hydrogen-containing compounds. The hot stripper is also maintained within the desired temperature conditions to remove 45 to 55% of the sulfur as hydrogen sulfide and mercaptans, as well as a portion of nitrogen as ammonia and cyanides.

This concept advances the development of a heavy oil (residual oil) catalytic cracker and high temperature cracking unit for conventional gas oils. The process combines the control of catalyst deactivation with controlled catalyst carbon-contamination level and control of temperature levels in the stripper and regenerator.

The hot stripper temperature controls the amount of carbon removed from the catalyst in the hot stripper. Accordingly, the hot stripper controls the amount of carbon (and hydrogen, sulfur) remaining on the catalyst to the regenerator. This residual carbon level controls the temperature rise between the reactor stripper and the regenerator. The hot stripper also controls the hydrogen content of the spent catalyst sent to the regenerator as a function of residual carbon. Thus, the hot stripper controls the temperature and amount of hydrothermal deactivation of catalyst in the regenerator. This concept may be practiced in a multi-stage, multi-temperature stripper or a single stage stripper.

Employing a hot stripper, to remove carbon on the catalyst, rather than a regeneration stage reduces air pollution, and allows all of the carbon made in the reaction to be burned to $CO_2$, if desired.

The striped catalyst is cooled (as a function of its carbon level) to a desired regenerator inlet temperature to control the degree of regeneration desired, in combination with the other variables of $CO/CO_2$ ratio desired, the amount of carbon burn-off desired, the catalyst recirculation rate from the regenerator to the hot stripper, and the degree of desulfurization/ denitrification/decarbonization desired in the hot stripper. Increasing $CO/CO_2$ ratio decreases the heat generated in the regenerator, and accordingly decreases the regenerator temperature. Burning the coke, adhering to the catalyst in the regenerator, to CO removes the coke, as would burning coke to $CO_2$, but burning to CO produces less heat than burning to $CO_2$. The amount of carbon (coke) burn-off affects regenerator temperature, because greater carbon burn-off generates greater heat. The catalyst recirculation rate from the regenerator to the hot stripper affects regenerator temperature, because increasing the amount of hot catalyst from the regenerator to the hot stripper increases hot stripper temperature. Accordingly, the increased hot stripper temperature removes increased amounts of coke so less coke need burn in the regenerator; thus, regenerator temperature can decrease.

The catalyst cooler controls regenerator temperature, thereby allowing the hot stripper to be run at temperatures between 100° F. above a riser exit temperature to 1500° F., which facilitate controlling sulfur and hydrogen, while allowing the regenerator to be run independently at temperatures at least 100° F. hotter than the stripper, while preventing regenerator temperatures greater than 1600° F. which deactivate catalyst.

Use of the catalyst cooler on catalyst exiting the stripper also allows circulation of catalyst to the regenerator riser to increase catalyst density in the regenerator riser, while controlling the regenerator temperature. This reduces catalyst deactivation and provides additional control.

While specific embodiments of the method and apparatus aspects of the invention have been shown and described, it should be apparent that the many modifications can be made thereto without departing from the spirit and scope of the invention. Accordingly, the invention is not limited by the foregoing description, but is only limited by the scope of the claims appended thereto.

I claim:

1. A process for controlling the fluid catalytic cracking of a feedstock containing hydrocarbons, comprising the steps of:

passing a mixture comprising catalyst and said feedstock through a riser conversion zone under fluid catalytic cracking conditions to crack said feedstock;

passing said mixture, having a riser exit temperature, from said riser into a fluid catalytic cracking reactor vessel;

separating a portion of catalyst from said mixture, with the remainder of said mixture forming a reactor vessel gaseous stream;

heating said separated catalyst portion by a heating step consisting essentially of combining said separated catalyst portion with a portion of regenerated catalyst from a fluid catalytic cracking regenerator vessel to form combined catalyst;

stripping said combined catalyst, by contact with a stripping gas stream, consisting essentially of steam at a stripping temperature between 100° F. above said riser exit temperature and 1500° F., said regenerated catalyst portion having a temperature between 100° F. above said stripping temperature and 1600° F. prior to heating said separated catalyst to produce a stripped catalyst;

cooling said stripped catalyst, prior to passing it into said regenerator vessel, to a temperature sufficient to cause said regenerator vessel to be maintained at a temperature between 100° F. above said stripping temperature and 1600° F., wherein said cooling step comprises passing said stripped catalyst stream to a heat-exchanger located outside said reactor vessel; and regenerating said cooled catalyst stream in said fluid catalytic cracking regenerator vessel by contact with an oxygen-containing stream at fluid catalytic cracking regeneration conditions.

2. The process of claim 1, wherein said stripped catalyst stream is indirectly heat-exchanged with a heat-exchange medium in said heat exchanger.

3. The process of claim 2, wherein said riser exit temperature ranges between 900° and 1100° F., and said heatexchanger cools said stripped catalyst stream to cause said catalyst in said regenerator vessel to be maintained at a temperature between 150° F. above said stripping step temperature and 1600° F.

4. The process of claim 3, wherein said heating step and said stripping step occur within said reactor vessel and said stripping step occurs at a stripping temperature between 150° F. above said riser exit temperature and 1400° F. and a residence time for said gaseous stream from 0.5 to 5 seconds.

5. The process of claim 4, wherein said separating step comprises separating the mixture from said riser conversion zone in a closed cyclone system in communication with said riser conversion zone.

6. The process of claim 5, wherein said riser exit temperature ranges from 1000° to 1050° F. and said stripped catalyst stream is cooled in said heat-exchanger to between 50° and 150° F. below said stripping temperature, said heat-exchanger thereby causing said regenerator vessel temperature to be maintained independently of said stripping temperature.

7. The process of claim 6, wherein said separated catalyst portion of said combined catalyst contains sulfur-containing compounds and hydrogen-containing compounds derived from said feedstock, and said stripping step removes 45 to 55% of said sulfur-containing compounds and 70 to 80% of said hydrogen-containing compounds in said separated catalyst portion.

8. The process of claim 7, wherein said combined catalyst passes countercurrently to said stripping gas during said stripping step.

9. A process for controlling the fluid catalytic cracking of a feedstock containing hydrocarbons and sulfur-containing compounds, comprising the steps of:

passing a mixture comprising catalyst and said feedstock through a riser conversion zone at fluid catalytic cracking conditions to crack said feedstock;

passing said mixture, having a riser exit temperature between 1000° and 1050° F., from said riser conversion zone to a closed cyclone system located within a fluid catalytic cracking reactor vessel;

separating a portion of catalyst from said mixture in said closed cyclone system, with the remainder of said mixture forming a reactor vessel gaseous stream;

heating said separated catalyst portion by a heating step consisting essentially of combining said separated catalyst portion of said reactor vessel with a portion of regenerated catalyst from a fluid catalytic cracking regenerator vessel to form combined catalyst;

stripping said combined catalyst by contact with a stripping gas stream consisting essentially of steam in said reactor vessel, under stripping conditions comprising a stripping temperature between 150° F. above said riser exit temperature and 1400° F., said regenerated catalyst portion having a temperature between 150° F. above said stripping temperature and 1600° F. prior to heating said separated catalyst, wherein said separated catalyst portion contains sulfur-containing compounds and hydrogen-containing compounds derived from said feedstock, said stripping conditions are sufficient to separate 45 to 55% of said sulfur-containing compounds and 70 to 80% of said hydrogen-containing compounds in said separated catalyst portion of said combined catalyst to produce a gaseous stream, and said gaseous stream comprises stripping gas and molecular hydrogen, hydrocarbons and sulfur-containing compounds separated from said separated catalyst, said stripping conditions further comprising a residence time from 0.5 to 5 seconds for said gaseous stream, wherein said sulfur-containing compounds in said gaseous stream consist essentially of hydrogen sulfide and mercaptans;

cooling said stripped catalyst stream to a temperature between 50° and 150° F. below said stripping temperature, by indirect heat-exchange with a heat-exchange medium in a heat exchanger located outside said reactor vessel, causing said catalyst in said regenerator vessel to be maintained at a temperature between 150° F. above said stripping temperature and 1600° F., thereby maintaining said regenerator vessel temperature independently of said stripping temperature; and regenerating said cooled catalyst stream in said fluid catalytic cracking regenerator vessel, by contact with an oxygen-containing stream under fluid catalytic cracking regeneration conditions.

* * * * *